United States Patent [19]

Shinogle et al.

[11] Patent Number: 4,922,878

[45] Date of Patent: May 8, 1990

[54] METHOD AND APPARATUS FOR CONTROLLING A SOLENOID OPERATED FUEL INJECTOR

[75] Inventors: Ronald D. Shinogle; Thomas G. Ausman, both of Peoria, Ill.

[73] Assignee: Caterpillar Inc., Peoria, Ill.

[21] Appl. No.: 245,096

[22] Filed: Sep. 15, 1988

[51] Int. Cl.[5] ..... F02D 41/30

[52] U.S. Cl. ..... 123/490; 361/154

[58] Field of Search ..... 123/490; 361/152, 154

[56] References Cited

U.S. PATENT DOCUMENTS

| | | | |
|---|---|---|---|
| 3,682,144 | 8/1972 | Suda | 123/490 |
| 4,219,154 | 8/1980 | Luscomb | 239/91 |
| 4,266,261 | 5/1981 | Streit et al. | 361/154 |
| 4,452,210 | 6/1984 | Sasayama et al. | 361/154 X |
| 4,511,945 | 4/1985 | Nielsen | 361/154 |
| 4,604,675 | 8/1986 | Pflederer | 361/155 |
| 4,631,628 | 12/1986 | Kissel | 123/490 X |
| 4,653,455 | 3/1987 | Eblen et al. | 123/506 |
| 4,680,667 | 7/1987 | Petrie | 361/154 |

FOREIGN PATENT DOCUMENTS

| | | |
|---|---|---|
| 0184940 | 6/1986 | European Pat. Off. . |
| 2025183 | 1/1980 | United Kingdom . |

*Primary Examiner*—Willis R. Wolfe

*Attorney, Agent, or Firm*—Robert E. Muir; Kirk A. Vander Leest

[57] ABSTRACT

A solenoid control circuit provides energy to selected solenoids to control actuation of a control valve of a fuel injector and, hence, the timing and duration of fuel delivered to each cylinder of an internal combustion engine. The current provided to each solenoid is also controlled to provide a three tier current waveform having a pull-in current level, a hold-in current level, and an intermediate current level. Energizing the solenoid at the pull-in current level starts movement of the control valve. After the control valve starts to move, the current level is reduced to the intermediate level, which is less than the pull-in current level, but great enough to continue movement of the control valve. Further reduction of the current level to the hold-in level, which is less than either of the other current levels but sufficient to hold the control valve at the moved position. The solenoid is then de-energized and the control valve returned to its initial position to stop the flow of fuel to the engine. The foregoing is repeated for each of the other control valves of the fuel injectors to save energy and reduce the heat to be dissipated.

10 Claims, 2 Drawing Sheets

METHOD AND APPARATUS FOR CONTROLLING A SOLENOID OPERATED FUEL INJECTOR

DESCRIPTION

1. Technical Field

This invention relates generally to solenoid operated fuel injectors for internal combustion engines, and more particularly to a method and apparatus for controlling the energy transfer to such fuel injectors.

2. Background Art

In electronically controlled fuel injection systems, it is imperative that solenoids be provided that are capable of high speed operation and have consistently reproducible stroke characteristics. Consider an engine operating at 3000 rpm and more, and requiring fuel injected into each cylinder at five millisecond intervals and the entire injection pulse occurs over only a three millisecond period. Any defect in the operation of the solenoid results in erroneous quantities of fuel being delivered which can adversely affect the performance of the engine and/or engine emissions.

High speed solenoid operation is obviously an absolute necessity; however, the need for consistently reproducible stroke characteristics is a less obvious but equally important requirement. A reproducible solenoid stroke provides the precise control needed to obtain maximum fuel efficiency, power output, and engine life and has also been shown to have beneficial effects on the quantity and type of exhaust emissions. These benefits extend from the fact that the quantity of fuel injected into a cylinder is typically controlled by the duration of time for which the solenoid is maintained in an energized configuration. Thus, a given voltage applied to the solenoid for a given duration of time should result in the solenoid being operated to an energized configuration for a substantially standard duration of time and thereby deliver a standard preselected quantity of fuel. Once the relationship between voltage, time and quantity of fuel has been established, it should remain constant throughout the useful life of the apparatus. Therefore, a fuel injection solenoid control can provide advantageous control of engine operation over the entire range of engine speed by delivering a regulated current for a variable duration of time.

Further, in the operation of a fuel injection system on a multicylinder engine, a fuel injection solenoid is provided for each engine cylinder and must be energized and de-energized for each compression stroke of the corresponding engine cylinder. Typically, the energy stored in the solenoid is transformed into heat by a diode and solenoid resistance combination placed in the flyback current path of each solenoid. The magnitude of the energy disposed of in this manner is significant and directly results in an increase to the cost of the system. The heat generated by the discharging solenoids exacerbates the problem of heat dissipation in an already thermally hostile environment. Additional means must be provided to remove the excess heat to maintain the reliability of the electronic hardware. Increased heat dissipation capability is a directly measurable cost and requires a larger package.

Significant savings can be attained if the amount of energy required to drive the solenoid can be reduced.

U.S. Pat. No. 4,604,675, issued Aug. 5, 1986 to Mark R. Pflederer, discloses energy savings by using the energy stored in the solenoid coil to recharge a capacitor in response to the coil and capacitor being disconnected. It also discloses a fuel injection solenoid driver circuit in which energy is delivered to the solenoid at two different levels or tiers.

It would be advantageous to effect still greater energy savings. The present invention is directed to that end.

DISCLOSURE OF THE INVENTION

In accordance with one aspect of the present invention there is provided an internal combustion engine having a plurality of cylinders, each cylinder having a fuel injector with a solenoid operated control valve, a fuel system for feeding fuel under pressure to each fuel injector, and an electronic control for controlling operation of the control valves and the fuel system, the electronic control including means for energizing the solenoid at an initial current level to move the control valve and for energizing the solenoid at a lower current level to hold the control valve at the moved position, and the means for energizing the solenoid being operative to reduce the initial current level to a level intermediate the initial and lower levels after the control valve starts to move.

In accordance with another aspect of the present invention there is provided a method of controlling operation of each solenoid operated control valve of a plurality of fuel injectors each of which injects fuel into a respective cylinder of a multicylinder internal combustion engine including the steps of: energizing the solenoid at a first current level to start movement of the control valve; after the control valve starts to move, reducing the current level to a second level less than the first current level but great enough to continue movement of the control valve; further reducing the current level to a third level less than either the first and second current levels but sufficient to hold the control valve at the moved position; deenergizing the solenoid and returning the control valve to its initial position to stop the flow of fuel; and repeating the foregoing steps for each of the other control valves of said fuel injectors.

BEST MODE FOR CARRYING OUT THE INVENTION

As used herein, the term solenoid is intended to include windings of any shape through which current flows to establish a magnetic field and equivalents thereto. For example, the solenoid could be in a generally frusto-conical shape.

Solenoid operated fuel injectors are known in the art and it is perceived that any of them can be used with the present invention. One suitable solenoid operated fuel injector is shown in U.S. Pat. No. 4,219,154, issued Aug. 26, 1980 to Douglas A. Luscomb. It discloses a solenoid controlled, hydraulically actuated unit injector. Another suitable solenoid operated fuel injector is shown in U.S. Pat. No. 4,653,455, issued Mar. 31, 1987 to Eblen et al. It discloses a solenoid controlled but mechanically actuated unit injector.

Figure 1:
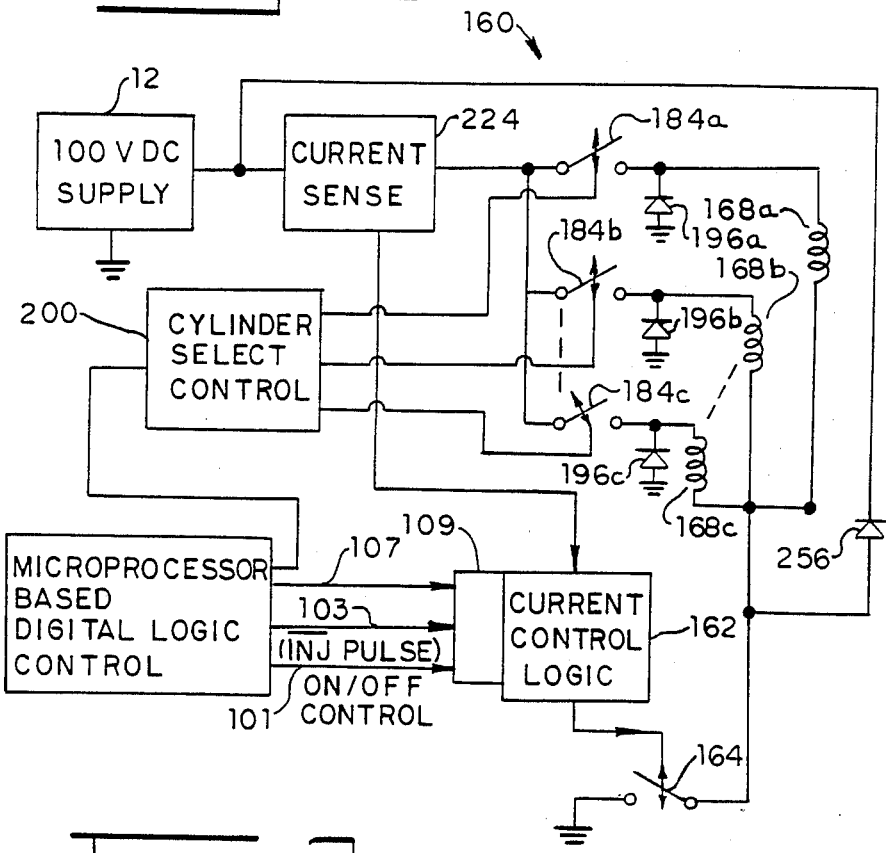
FIG. 1 is a diagram of a solenoid control circuit, but showing only three solenoids for illustrative purposes.

Reference in made to the circuit disclosed in the aforementioned U.S. Pat. No. 4,604,675 which is hereby incorporated by reference. FIG. 1 of the drawings is a simplified version of said circuit where functionally equivalent parts are identified by the same numerals as in said '675 patent. In FIG. 1, however, the flyback features are inverted. It should be understood that the inversion of the flyback features of the circuit comprises no part of the present invention.

A brief description of FIG. 1 will now be given. A voltage supply 12 (which may be stepped up from typical 12 V battery voltage as shown in FIG. 1 of the '675 patent) provides energy for a solenoid control circuit 160. An external control device 99 supplies signals to the solenoid control circuit 160. On/off control signals (injector pulse) as shown at 101 and pull-in/hold signals as shown at 103, are delivered to a current control logic 162.. A cylinder select control 200 likewise receives a signal as shown at 105 and operates selected switches 184*a*–184*c* to establish a pull-in current level B1 (see FIG. 3) in the corresponding solenoid 168*a*–168*c*. The pull-in current energizes the solenoid which provides a force to start movement of a control valve of a fuel injector (not shown). A current sense 224 provides a signal to the current control logic 162 to control upper and lower limits $I_1$, $I_2$ (see FIG. 3) of the current level provided to the solenoids. The current control logic 162 signals a modulation driver 164 to complete a circuit to ground when it determines current in the switched solenoid 168*a*, 168*b* or 168*c* should be increased. Diodes 196*a*–196*c* and 256 (in cooperation with driver 164) operate to provide flyback circuits to protect switches 184 and 164, and reduce energy in the manner described in the '675 patent.

Figure 3:
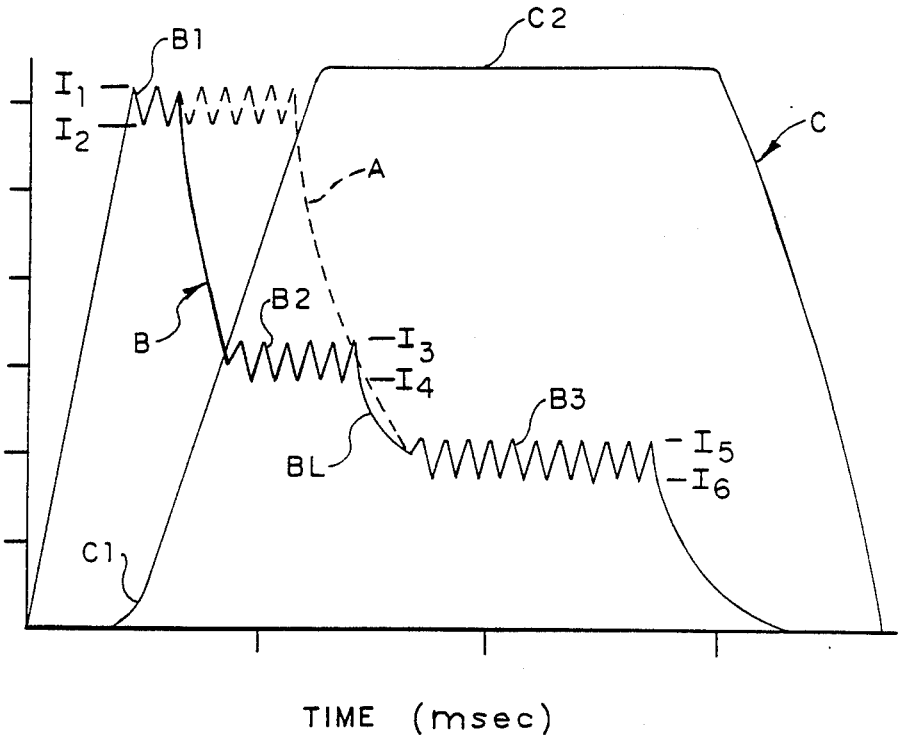
FIG. 3 is a graphical illustration of the current wave form and the control valve displacement and also showing a prior art waveform.

In accordance with the present invention it is desired to provide a lower level hold-in current B3 and an intermediate current level B2, hereinafter described in detail. FIG. 1 also shows additional features illustrative of one arrangement for accomplishing this. The addition of a single additional signal 107 to a portion 109 of the current control logic 162 provides an additional reference signal which is used to control the intermediate current level B2. As shown in FIG. 3, the current sense 224 provides a signal to the current control logic 162 to control upper and lower limits $I_3$, $I_4$ of intermediate current level B2 and limits $I_5$, $I_6$ of the hold-in current level B3. Additional levels may be utilized to further reduce the energy level in given applications.

Figure 2:
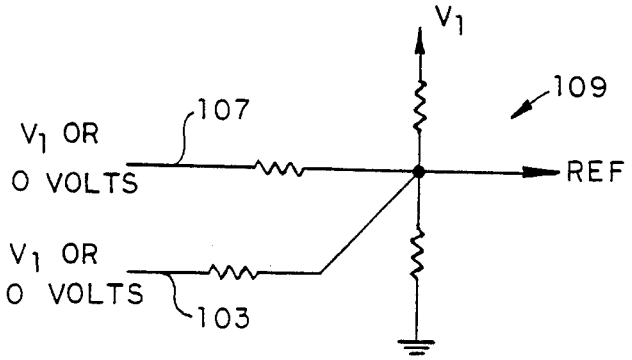
FIG. 2 is a circuit diagram of a portion of the current control logic.

Current control logic portion 109 is shown in FIG. 2 in the form of a circuit which receives input signals 103, 107 through resistors $R^1$, $R^2$ and provides a reference voltage signal REF. Signal REF is used by the current control logic 162 to control the pull-in current level B1, the intermediate current level B2 and the hold-in current level B3.

Two current wave forms are shown in FIG. 3. The wave form illustrated by dashed line A is a two tier waveform and corresponds to the waveform shown in FIG. 4B of the '675 patent. In accordance with the present invention current waveform B is a three tier waveform having a first or pull-in current level B1, a third or hold-in current level B3, and a second or intermediate current level B2. This differs from waveform A by the addition of the intermediate level B2. This additional level reduces the amount of energy supplied to the solenoid. The multi-tier waveform B allows taylor-ing the current wave to keep the solenoid in the most energy efficient operational mode. As the control valve travels, the magnetic characteristics of the solenoid circuit become more efficient, requiring less current. The area between waveform A and waveform B represents energy savings. From initial indications a 33% savings in energy is achievable.

Superimposed curve C shows displacement of the control valve of the fuel injector at the same time intervals as the wave forms. As can be seen, the pull-in current level B1 operates to overcome the at-rest inertia of the control valve and is continued for a period of time sufficient to cause the control valve to start to move as indicated at C1. It is perceived that the current level can then be reduced to the intermediate level B2 which is less than the pull-in current level B1, but great enough to continue movement of the control valve toward its open position as indicated at C2. The intermediate level B2 is held for a preselected period of time which advantageously is until the control valve reaches its open position C2. Then the current level is reduced to the hold-in level B3 which is less than either of the other current levels but sufficient to hold the control valve at the open position.

While the circuit has been described as one in which the second or intermediate current level starts and ends at predetermined time intervals, it is perceived that it could have variable timing by utilizing a feedback system (not shown). Such a feedback system could sense a change in the current decay pattern, or a change in amplitude of the current trace when modulation driver 164 is switched on and off at fixed times. In a two tier wave form the ability to sense control valve movement is difficult when control valve dynamics change during differing operating cycles. In the three tier wave form disclosed herein valve opening may be sensed at the intermediate level B2 which can be varied in length and is easy to regulate, or between that level and third level B3, as for example on line BL. It can be seen that sensing at lower current levels will result in energy savings.

The much more efficient three tier waveform B permits an increased preload on any spring associated with the control valve if required. Under that circumstance injector performance can be improved while still using less energy than would be required by a two tier waveform and less spring pressure.

The above described solenoid control circuit 160 is one that may be utilized to control operation of each solenoid operated control valve of a plurality of fuel injectors each of which injects fuel into a respective cylinder of a multicylinder internal combustion engine by energizing the solenoid at a first current level B1 to start movement C1 of the control valve; after the control valve starts to move, reducing the current level to a second level B2 less than the first current level but great enough to continue movement of the control valve; further reducing the current level to a third level B3 less than either the first and second current levels B1,B2 but sufficient to hold the control valve at the moved position C2; deenergizing the solenoid 168*a* and returning the control valve to its initial position to stop the flow of fuel to the cylinder; and repeating the foregoing steps for each of the other solenoids 168*b*–168*c* of said fuel injectors to save energy and reduce heat to be dissipated.

In addition to energy savings, the three tier wave form reduces the root mean squared current levels that must be dissipated in the solenoid. Less heat means improved life and/or that the design criteria of the solenoid can be less stringent.

Other aspects, objects and advantages can be obtained from a study of the drawings, the disclosure and the appended claims.

We claim:

1. A method of controlling operation of each solenoid operated control valve of a plurality of fuel injectors each of which injects fuel into a respective cylinder of a multicylinder internal combustion engine including the steps of:

energizing the solenoid at a first current level to start movement of the control valve;

after the control valve starts to move, reducing the current level to a second level less than the first current level but great enough to continue movement of the control valve;

maintaining the solenoid current at the second level for a period of time;

further reducing the current level to a third level less than either the first and second current levels but sufficient to hold the control valve at the moved position;

deenergizing the solenoid and returning the control valve to its initial position to stop the flow of fuel; and repeating the foregoing steps for each of the other control valves of said fuel injectors to reduce energy required, reduce heat to be dissipated in the solenoid and its related circuit while maintaining optimum performance of the control valve.

2. A method of controlling operation of each solenoid operated control valve as set forth in claim 1, in which the step of reducing the current level to a second level is performed at a preselected time after energizing the solenoid.

3. A method of controlling operation of each solenoid operated control valve as set forth in claim 2, in which the step of the step of maintaining the second current level is continued at least until the control valve attains its moved position.

4. A method of controlling operation of each solenoid operated control valve of a plurality of fuel injectors each of which injects fuel into a respective cylinder of a multicylinder internal combustion engine comprising the steps of:

modulating a current through the solenoid between first and second thresholds for a first predetermined period of time to start movement of the control valve;

modulating the current through the solenoid between third and fourth thresholds which are lower than said first and second thresholds but sufficient to maintain movement of the valve for a second predetermined period of time;

modulating the current through the solenoid between fifth and sixth thresholds which are lower than the other threshold but sufficient to hold the valve in its moved position for a third preselected period of time;

deenergizing the solenoid and returning the control valve to it initial position to stop the flow of fuel; and, repeating the foregoing steps for each of the other control valves of said fuel injectors.

5. A method of controlling each solenoid operated valve as set forth in claim 4, wherein the second predetermined period of time is sufficient for the valve to reach its moved position.

6. An apparatus for controlling operation of a solenoid operated control valve of a fuel injector which injects fuel into internal combustion engine, comprising:

first means for energizing the solenoid at a first current level to start movement of the control valve;

second means for reducing the current level to a second level less than the first current level but great enough to continue movement of the control valve and for maintaining the solenoid current at the second level for a period of time;

third means for further reducing the current level to a third level less than either the first and second current levels but sufficient to hold the control valve at the moved position; and fourth means for deenergizing the solenoid and returning the control valve to its initial position to stop the flow of fuel.

7. An apparatus for controlling operation of a solenoid operated valve as set forth in claim 6, wherein said second means reduces the current to the second level at a preselected time.

8. An apparatus for controlling operation of a solenoid operated valve as set forth in claim 6, wherein said current is maintained at said second level at least until the control valve reaches its moved position.

9. An apparatus for controlling operation of each solenoid operated control valve of a plurality of fuel injectors each of which injects fuel into a respective cylinder of a multicylinder internal combustion engine, comprising:

first means for energizing the solenoid to a first current threshold and for modulating the current through the solenoid between said first threshold and a second threshold for a first predetermined period of time to start movement of the control valve;

second means for modulating the current through the solenoid between third and fourth thresholds which are lower than said first and second thresholds but sufficient to maintain movement of the valve for a second predetermined period of time;

third means for modulating the current through the solenoid between fifth and sixth thresholds which are lower than the other thresholds but sufficient to hold the valve in its moved position for a third preselected period of time; and fourth means for deenergizing the solenoid thereby returning the control valve to it initial position to stop the flow of fuel.

10. An apparatus for controlling operation of each solenoid operated valve as set forth in claim 9, wherein said second predetermined period of time is sufficient for the solenoid to reach its moved position.

* * * * *